US007123848B2

(12) United States Patent
Clement et al.

(10) Patent No.: US 7,123,848 B2
(45) Date of Patent: Oct. 17, 2006

(54) METHOD AND SYSTEM FOR MANAGING PRINT JOBS FOR A PRINTER TO MAXIMIZE THROUGHPUT

(75) Inventors: Thomas J. Clement, Raleigh, NC (US); Jerry W. Pearce, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 187 days.

(21) Appl. No.: 10/864,183

(22) Filed: Jun. 9, 2004

(65) Prior Publication Data

US 2005/0276618 A1 Dec. 15, 2005

(51) Int. Cl.
*G03G 15/00* (2006.01)

(52) U.S. Cl. ..... 399/24; 358/1.14; 358/1.15; 399/8; 399/82

(58) Field of Classification Search ..... 399/24, 399/82, 27, 83, 9; 358/1.14, 1.15
See application file for complete search history.

(56) References Cited

U.S. PATENT DOCUMENTS 6,266,493 B1 * 7/2001 Farrell et al. ..... 399/24
6,285,843 B1 * 9/2001 Obata ..... 399/82
6,366,744 B1 * 4/2002 Phillips et al. ..... 399/24
6,453,129 B1 9/2002 Simpson et al. ..... 399/23
6,915,090 B1 * 7/2005 Fukaya ..... 399/82 X
2002/0113990 A1 8/2002 Hernandez ..... 358/1.15
2002/0140959 A1 * 10/2002 Harper ..... 358/1.14 X
2003/0002074 A1 1/2003 Miyano ..... 358/1.15
2003/0071726 A1 4/2003 Hopper et al. ..... 340/540
2003/0090696 A1 * 5/2003 Willis et al. ..... 358/1.14
2004/0085565 A1 * 5/2004 Owen et al. ..... 358/1.14
2004/0135838 A1 * 7/2004 Owen et al. ..... 399/24 X

* cited by examiner

*Primary Examiner*—Sophia S. Chen
(74) *Attorney, Agent, or Firm*—Sawyer Law Group LLP

(57) ABSTRACT

Aspects for managing print jobs for a printer are described. The aspects include an examination of a print queue of print jobs based on a level of consumable resources available in the printer. Further, an order of the print jobs in the printer is adjusted to prioritize printing of the print jobs that can be completely printed with the consumable resources available, wherein the printer realizes increased throughput and minimized downtime.

7 Claims, 2 Drawing Sheets

METHOD AND SYSTEM FOR MANAGING PRINT JOBS FOR A PRINTER TO MAXIMIZE THROUGHPUT

FIELD OF THE INVENTION

The present invention relates to high speed, self-service printers, and more particularly to managing print jobs in a high speed, self-service printer to maximize throughput.

BACKGROUND OF THE INVENTION

High speed printers need to maximize throughput. One aspect of ensuring maximum throughput is minimizing printer downtime for replenishment of consumable resources. Many printers today provide some alert when certain printer resources are close to becoming depleted or have been depleted. For instance, printers typically include a small Liquid Crystal Display (LCD) screen to display a message that toner is low, paper is out, etc. Alternatively, the printer driver may send a message for display at a computer connected to the printer indicating which resource is low/depleted. To implement such alert systems, sensors are used to detect when a resource is depleted. For instance, the paper tray would include an electrical or electromechanical sensor to detect when the paper tray is empty. A toner and oil cartridge would include sensors to detect when the toner level is near or at empty. The sensor, upon detecting that the resource is close to or at depletion, would signal the printer processor and the printer processor would, in response, send an alert message to an LCD screen at the printer or to a printer management software program running on an attached computer.

Normally, network-connected self-service printers depend on the printer user to replenish consumable resources that have been depleted. Thus, if a printer runs out of a consumable after a job starts, the printer stops and waits for service. Throughput drops to zero. Such inefficiency creates a need for managing print jobs in a manner that eliminates or minimizes printers stopping in the middle of a job due to a lack of consumable resources.

SUMMARY OF THE INVENTION

Aspects for managing print jobs for a printer are described. The aspects include an examination of a print queue of print jobs based on a level of consumable resources available in the printer. Further, an order of the print jobs in the printer is adjusted to prioritize printing of the print jobs that can be completely printed with the consumable resources available, wherein the printer realizes increased throughput and minimized downtime.

By taking into consideration the level of consumable resources available and needed, the present invention provides greater efficiency in managing print jobs to increase throughput. In a straightforward manner, the printer keeps operating as much as possible with the available resources to minimize printer downtime. These and other advantages of the aspects of the present invention will be more fully understood in conjunction with the following detailed description and accompanying drawings.

DETAILED DESCRIPTION

The present invention relates to maximizing throughput in high speed, self-service printers. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown but is to be accorded the widest scope consistent with the principles and features described herein.

Figure 1:
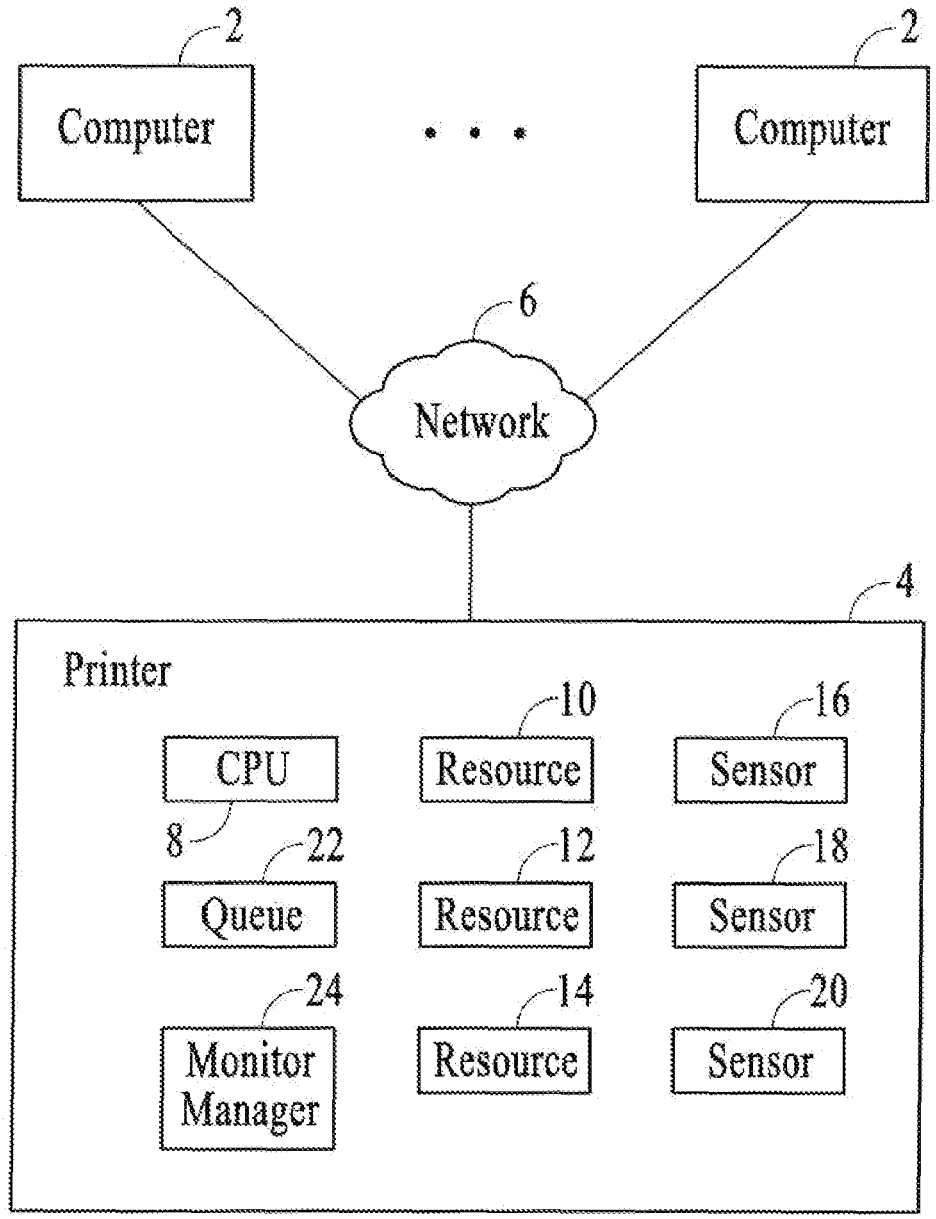
FIG. 1 illustrates a printer environment in which aspects of the invention are implemented.

FIG. 1 illustrates a printer environment in which aspects of the invention are implemented. A plurality of computers 2 are in communication with a printer 4 over a network 6. The computer(s) 2 may comprise any computing system known in the art, such as a personal computer, laptop, palm top, telephony device, desktop system, mainframe, etc. The network 6 may comprise any computer network known in the art, including a Local Area Network (LAN), Wide Area Network (WAN), Ethernet, the Internet, etc. The printer 4 may comprise any type of high speed, self-service printer known in the art, including, for example, IBM Infoprint 20. The printer 4 includes a printer central processing unit (CPU) 8 and a plurality of consumable resources 10, 12, and 14. The resources may comprise any type of resource consumed by the printer 4, such as paper, toner, fuser oil, etc. For each of the resources 10, 12, and 14 there is a resource sensor 16, 18, and 20 that detects a level of the resource, particularly when the resource is approximately depleted. For paper resources, the resource sensor would comprise an electromechanical sensor that detects paper in the input tray. For toner and fuser oil, the sensor may comprise an electrical sensor in the toner and fuser oil cartridge that detects the level of toner and fuser oil.

In accordance with the present invention, a resource monitor and queue manager 24 is included that takes into consideration the level of consumable resources on hand when managing print jobs in a print queue 22. Preferably, the process is provided as a program instructions of a suitable programming language and stored on a computer readable medium for performance by the printer CPU 8, e.g., is provided as part of the printer's firmware. In an alternate embodiment, a computer set up as a print queue manager for the printer could also be used, and the process could be provided as an application program running in that computer.

Figure 2:
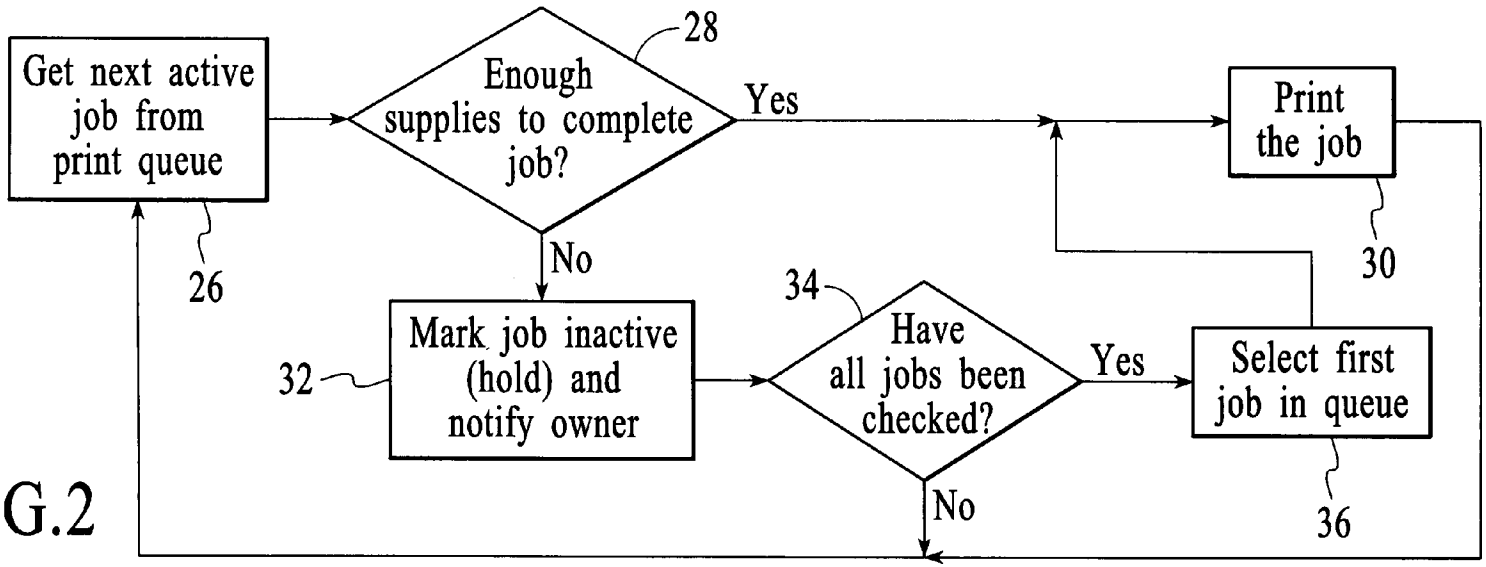
FIG. 2 illustrates a block flow diagram of a main print queue process that utilizes a consumable resources-based print queue priority of the present invention.

FIG. 2 illustrates a block flow diagram of a main print queue process that utilizes a consumable resources-based print queue priority. The process begins by selecting a first/next active job from the print queue 22 (step 26). A determination is made for the selected print job based on the level of consumable resources available in the printer 4 and the level of consumable resources needed for the selected print job (step 28). As is well understood in the art, the approximate amount of remaining paper, toner and ink is known and reported by many printers today. The number of pages in a print job is also known. When enough resources are available to complete the job, the job is printed (step 30). The process then returns to step 26 to repeat the process with a next active job in the print queue.

When there are not enough resources to complete the job (i.e., step 28 is negative), the job is marked inactive/placed on hold in the print queue (22), and the job owner is notified that the printer requires service (step 32). When there are still jobs in the queue to be checked (as determined via step 34), the process proceeds to step 26 to check a next active job in the print queue. In this manner, the print queue is searched for another job to print, where the search criterion is to find the next scheduled job that can be completed with the remaining resources. Any job found that cannot be completed will also be put on hold and its owner notified. In general, the large jobs will be put on hold and smaller jobs will be selected to keep the printer printing while users are notified that the printer needs service. Once all jobs in the print queue that can complete with the available consumable resources have been processed, the first job in the print queue will be started even if there are insufficient consumable resources to complete the job (step 36).

Figure 3:
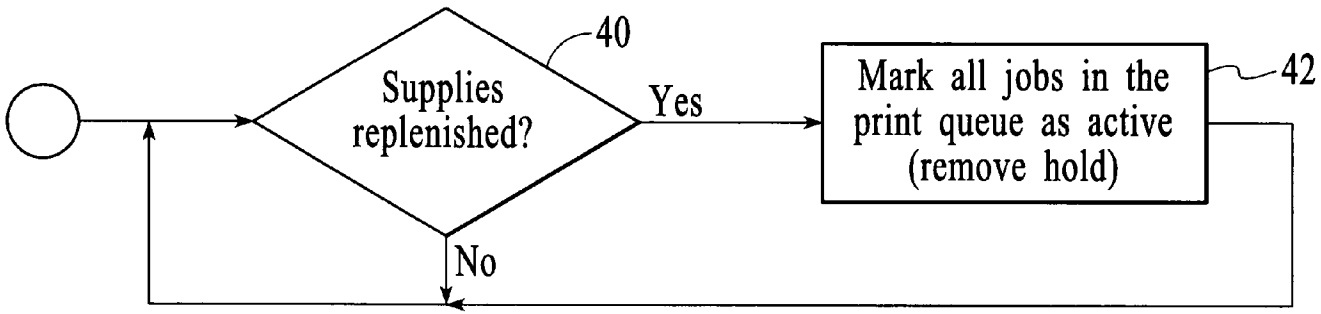
FIG. 3 illustrates a block flow diagram of a resource services handler of the present invention.

During the process of print queue management, the resource monfior and print queue manager 24 also checks for the replenishment of the printer supplies, shown as step 40 of FIG. 3. At any time, the printer may be serviced. This will cause all of the job hold flags to be cleared (step 42) and the normal print queue order will be restored.

Through the present invention, a straightforward and effecient approach to print queue management by a printer takes into consideration the level of consumable resources on hand when selecting the next job to print. In this manner, the printer keeps operating as much as possible with the available resources to aid in increased throughput and in minimized printer downtime.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for managing print jobs for a printer, the method comprising:

(a) examining a print queue of print jobs for a printer based on a level of consumable resources available in the printer the examining step (a) further comprises (a1) selecting a first print job in the print queue and (a2) comparing a needed level of consumable resources for the print job to the level of consumable resources available; and (b) adjusting an order of the print jobs in the print queue to prioritize printing of the print jobs that can be completely printed with the consumable resources available, wherein the printer realizes increased throughput and minimized downtime; wherein when the needed level is less than the level of consumable resources available, (c) the first print job is performed; wherein when the needed level exceeds the level of consumable resources available, (d) the first print job is put on hold and an owner of the first print job is notified of a servicing requirement of the printer repeating steps (a1) and (a2) and (c) or (d) for each next print job in the print queue; and (e) initiating printing of a first remaining print job regardless of the level of consumable resources available when all print jobs in the print queue have been examined and none remain that can be completely printed.

2. The method of claim 1 further comprising (f) identifying when servicing of the consumable resources in the printer has occurred and (g) removing all holds from print jobs in the print queue.

3. A system for managing print jobs for a printer, the system comprising:

a computer network; and a print queue manager coupled to the computer network, the print queue manager managing a print queue of print jobs and capable of examining the print jobs based on a level of consumable resources available in a printer, and adjusting an order of the print jobs to prioritize printing of the print jobs that can be completely printed with the consumable resources available, wherein the printer realizes increased throughput and minimized downtime wherein the print queue further selects each individual print job in order from the print queue and compares a needed level of consumable resources for the print job to the level of consumable resources available wherein when the needed level is less than the level of consumable resources available, the printer prints the print job wherein when the needed level exceeds the level of consumable resources available, the print queue manager places the print job on hold and notifies an owner of the print job that the printer requires servicing; wherein when the print queue manager has examined all the print jobs and none remain that can be completely printed, the print queue manager initiates printing of a first remaining print job regardless of the level of consumable resources available.

4. The system of claim 3 wherein the print queue manager further identifies when servicing of the consumable resources has occurred and removes all holds from print jobs in the print queue.

5. The system of claim 3 wherein the print queue manager comprises a manager in the printer.

6. A computer readable medium containing program instructions for managing print jobs for a printer, the program instructions comprising:

(a) examining a print queue of print jobs for a printer based on a level of consumable resources available in the printer the examining step (a) further comprises (a1) selecting a first print job in the print queue and (a2) comparing a needed level of consumable resources for the print job to the level of consumable resources available; and (b) adjusting an order of the print jobs in the print queue to prioritize printing of the print jobs that can be completely printed with the consumable resources available, wherein the printer realizes increased throughput and minimized downtime wherein when the needed level is less than the level of consumable resources available, (c) the first print job is performed wherein when the needed level exceeds the level of consumable resources available, (d) the first print job is put on hold and an owner of the first print job is notified of a servicing requirement of the printer repeating steps (a1) and (a2) and (c) or (d) for each next print job in the print queue and further comprising (e) initiating printing of a first remaining print lob regardless of the level of consumable resources available when all print jobs in the print queue have been examined and none remain that can be completely printed.

7. The computer readable medium of claim 6 further comprising (f) identifying when servicing of the consumable resources in the printer has occurred and (g) removing all holds from print jobs in the print queue.

* * * * *